United States Patent [19]

Webb

[11] 4,265,089

[45] May 5, 1981

[54] ICE MAKING APPARATUS AND METHOD

[75] Inventor: William M. Webb, Louisville, Ky.

[73] Assignee: General Electric Company, Louisville, Ky.

[21] Appl. No.: 120,184

[22] Filed: Feb. 11, 1980

[51] Int. Cl.[3] ..... F25C 1/10

[52] U.S. Cl. ..... 62/72; 62/137; 62/353

[58] Field of Search ..... 62/135, 137, 138, 72, 62/353

[56] References Cited

U.S. PATENT DOCUMENTS

| | | | |
|---|---|---|---|
| 2,941,378 | 6/1960 | Nelson | 62/73 |
| 3,252,293 | 5/1966 | Frei, Sr. | 62/135 |
| 3,283,526 | 11/1966 | Le Boeuf | 62/135 |
| 3,298,189 | 1/1967 | Beck et al. | 62/135 |
| 3,540,227 | 11/1970 | Eyman, Jr. et al. | 62/137 |
| 3,623,336 | 11/1971 | Fox | 62/233 |
| 3,654,772 | 4/1972 | Curry | 62/353 |
| 4,142,377 | 3/1979 | Fogt | 62/135 |

*Primary Examiner*—William E. Tapolcai, Jr.
*Attorney, Agent, or Firm*—Frederick P. Weidner; Radford M. Reams

[57] ABSTRACT

An ice maker in a freezer compartment and the method of controlling the ejection of ice pieces made by the ice maker, including a mold containing a plurality of spaced cavities for forming ice pieces, a water conduit for introducing water into the mold, a water valve, and an arrangement for signaling when the water in the mold is frozen, including a temperature sensor. A thermal mass is located in the freezer compartment spaced from the mold and in heat transfer relationship with the incoming water flowing through the conduit from the water valve to the mold. The temperature sensor is located in temperature sensing relationship with the thermal mass and is calibrated to actuate the signal arrangement when the water in the mold reaches a preselected temperature below 32° F.

23 Claims, 6 Drawing Figures

ICE MAKING APPARATUS AND METHOD

BACKGROUND OF THE INVENTION

This invention relates to ice makers and, more particularly to means and method for indicating when water in an ice maker mold is frozen.

Ice makers and methods adapted to cyclically undergo a series of operations, including the filling of a mold with water to be frozen, the freezing of water in the mold to produce ice pieces, and the removal of the ice pieces from the mold have been well known in the art. It is common to have such ice makers in household refrigerators having a below-freezing compartment in which the ice maker is installed. Various ice makers and methods have been utilized to sense the completion of the water freezing operation of an ice maker and thereupon initiate an ice removal operation of the ice maker. For instance, there has been one practice to initiate the ice removal operation in an automatic ice maker by means of apparatus intended to sense the temperature of the contents of the ice mold; i.e., thermostats or the like have been employed to measure the temperature of the contents of the ice mold, or of some portion of the mold adjacent the contents, and terminate the ice freezing operation and initiate an ice removal operation when a temperature is sensed which is low enough to indicate that the entire contents of the mold are in a frozen state. This arrangement is quite reliable on ice making apparatus having a stationary ice mold with a mechanical pusher which actually displaces the ice pieces from the mold. This type of ice maker is shown and described in U.S. Pat. No. 3,654,772. However, in ice makers that incoporate a flexible ice mold which is twisted to loosen the cubes which then fall from the overturned tray, it sometimes occurs that the ice pieces near the temperature sensor do not fall from the mold, but remain in place for the next cycle, whereupon the sensor will give a false signal. A flexible ice mold type of ice maker is shown and described in U.S. Pat. Nos. 3,252,293 and 4,142,377. In many of the flexible ice mold ice makers, a temperature sensor is not used, but rather a clock or timer is used which integrates compressor run time and at some predetermined time period, the clock will signal when the ice piece removal operation is to be initiated. This type of ice maker is shown and described in U.S. Pat. No. 3,623,336. The use of a timer, however, has the disadvantage that in order to make certain that all ice pieces are frozen, the predetermined time period must be much longer than is normally required for complete freezing, resulting in a daily ice rate which is lower than necessary .

Ice makers can also be controlled as to the time to initiate the ice removal operation, not by the temperature of the ice mold or its contents, but rather by the temperature of a thermal system analogous to the ice mold and its contents. The thermal system would include a heat storage body or mass thermally disassociated from the ice mold and its contents but subjected to the same refrigerating effect as is the ice mold in such a manner that the rate at which heat is removed from the heat storage mass should be analogous to the rate at which heat is removed from the contents of the ice mold. This type of an ice maker control system is shown and described in U.S. Pat. No. 2,941,378. Such an ice maker control system does not, however, take into account the fact that incoming water to refill the ice mold is relatively warm and its temperature can vary considerably from one time to another and from one geographical location to another. For instance, incoming water in the summer is much warmer in most cases than it is in the winter. Incoming water for an ice maker located in warm geographical regions is warmer generally than it is in cold regions. The thermally disassociated heat storage mass does not compensate for the temperature difference between it and the incoming warm water in the ice mold.

By my invention there is provided an ice maker and method which will provide a signal to initiate an ice removal operation when the water is frozen in the ice mold. The ice maker and method eliminates the problems noted above with regard to prior ice makers and controls therefor.

SUMMARY OF THEE INVENTION

According to one aspect of my invention, there is provided an ice maker in a freezer compartment with a mold containing a plurality of spaced cavities for forming ice pieces. There is also water conduit means for introducing water into the mold, a water valve, and signal means to indicate when the water in the mold is frozen including temperature sensing means. A thermal mass is located in the freezer compartment and spaced from the mold, the thermal mass is in heat transfer relationship with the incoming water flowing through the conduit from the water valve to the mold. The temperature sensing means is located in temperature sensing relationship with the thermal mass and is calibrated to actuate the signal means when the water in the mold reaches a preselected temperature below 32° F.

DESCRIPTION OF THE PREFERRED EMBODIMENT

Figure 1:
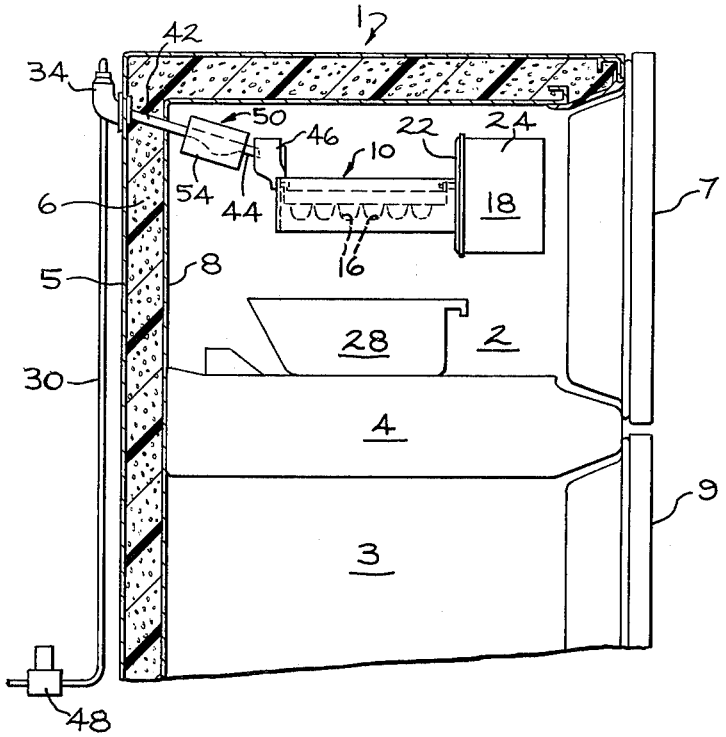
FIG. 1 is a side elevational view, partly in section, of a refrigerator cabinet having a freezer compartment on top and a fresh food compartment on the bottom and embodying one form of the present invention.
Figure 2:
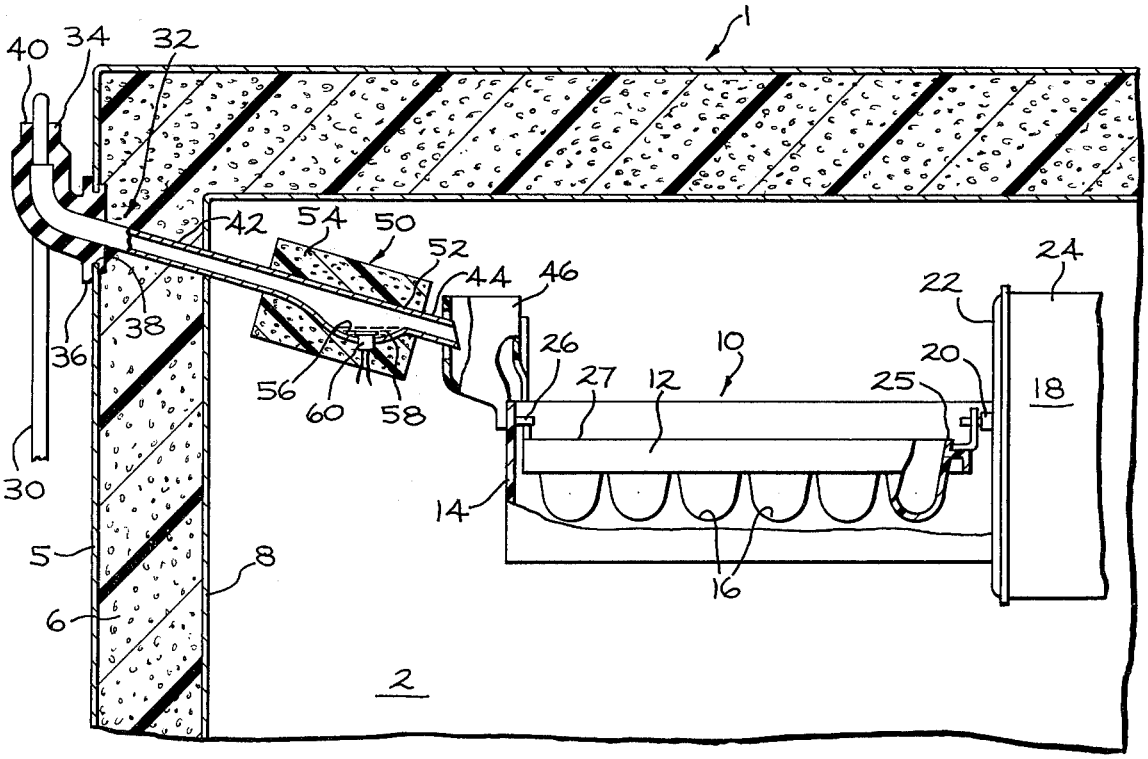
FIG. 2 is a side elevational view, partly in section, showing one form of the present invention as shown in FIG. 1 but enlarged to show details of the invention.

With particular reference to FIG. 1 and 2 of the drawings, there is shown one embodiment of the present invention used in a household refrigerator 1, including an upper freezer compartment 2 and a lower fresh food compartment 3 separated from the freezer compartment by an insulating partition 4. The respective compartments are also separated from the outer shell or outer cabinet walls 5 by an inner liner 8 and the spaces between the compartments and these walls are filled by means of insulation 6. A hinged door 7 permits access to the freezer compartment 2 and a hinged door 9 permits access to the fresh food compartment 3.

Both of the compartments are maintained at the desired refrigerating temperatures by means of an evaporator (not shown) which operates at a below freezing temperature and is arranged to maintain the interior of the freezer compartment 2 at below 32° F. and preferably near 0° F.

Located or positioned within the freezer compartment 2 is an icemaker 10. The common types of icemakers include those using a stationary ice piece mold and have the frozen ice pieces mechanically pushed from the molds as shown in U.S. Pat. No. 3,654,772 or the flexible ice mold type icemaker wherein the mold is flexed to release the ice pieces from the mold and the tray is inverted to drop the ice pieces into an underlying receptacle and this type of icemaker is shown in U.S. Pat. Nos. 3,252,293 and 4,142,377. Any type of icemaker can be used in connection with my invention, however, the preferred embodiment will describe a flexible mold type of ice maker. As seen in FIGS. 1 and 2 the icemaker 10 includes an elongated resilient twistable freezing tray or mold 12 in an upright position and supported at its two opposite ends for rotation on a bracket 14. The mold 12 is provided with walls dividing the interior thereof into rows of pockets or compartments 16 adapted to receive water to be frozen into ice pieces. The mold 12 is formed of any suitable material and preferably of polyethylene of such density as to be self-sustaining or non-saggable intermediate its ends when the compartments 16 thereof are substantially filled with water. There is provided a motor driven mechanism 18 having a housing 24 that has a drive shaft 20 extending beyond the front wall 22 of the housing 24. The drive shaft 20 is connected to one end 25 of the flexible mold 12 so that rotation of the drive shaft 20 will rotate the flexible mold 12. To accommodate rotation of the flexible mold 12 there is provided at the opposite end 27 of the mold 12 from the motor driven mechanism 18 a pivot 26 pivotally connecting the flexible mold 12 to the bracket 14. Some flexible mold icemakers operate utilizing a mechanism that rotates the flexible mold 12 360° and provides means for flexing the tray when it is in an inverted position to cause the ice pieces to be loosened in the compartments 16 whereupon they will fall by gravity into an underlying receptacle 28 (FIG. 1) used for storing and accumulating ice pieces. Other arrangements of flexible mold icemakers provide for flexing the mold 12 when it is inverted to release the ice pieces from the compartments 16 and then the mold 12 is reversely rotated to return it to its normal upright position as shown in FIGS. 1 and 2. The mechanism for accomplishing flexible mold 12 rotation and release of ice pieces from the compartments 16 is not necessary to be described in detail in connection with my invention as it is adaptable to whatever type of ice maker utilized. This operation is commonly referred to as harvesting the ice pieces.

After the ice pieces have been removed from the flexible mold 12 and the mold has been returned to is upright and level position as shown in FIGS. 1 and 2, water is introduced into the flexible mold 12 to fill the compartments 16 so that a new batch of ice pieces may be formed by freezing the water. To accomplish this water fill operation there is provided a conduit 30 connected at one end to a supply of water such as a pressurized household water pipe and the other end is connected to an assembly 32 for conducting the water into the interior of the freezer compartment 2 where the ice maker 10 is located. The assembly 32 includes an elbow shaped member 34 which has one end 36 thereof in sealing engagement with a hole 38 through the outer cabinet wall 5 and the other end 40 receives the water conduit 30. The elbow shaped member 34 receives through the one end 36 a transition conduit 42 which extends from the elbow shaped member 34 through the insulation 6 and the liner 8 into the interior of the freezer compartment 2. The end 44 of the transition conduit 42 opposite from the elbow shaped member 34 is received into a trough 46 which is supported on the bracket 14 of the ice maker 10. By this arrangement water flowing through conduit 30 passes into the elbow shaped member 34 and through the transition conduit 42 into the trough 46 whereupon it is distributed into the flexible mold 12 to thereby fill the compartments 16.

To control the amount of water introduced through the conduit 30 and into the compartments 16 of the flexible mold 12 there is provided a water valve 48 in the conduit 30 which may be actuated to allow water to flow through the conduit 30 and deactuated to prevent the flow of water through the conduit 30. Control of water valves, such as water valve 48, is well known in the art. Actuation and deactuation of the water valve 48 may be controlled by any suitable means also well known in the prior art. One such means is by a weight mechanism which, when the mold 12 is empty, the water valve 48 is actuated and when the mold 12 is filled to the desired height, the weight of the mold 12 and the water will cause a signal to be generated to deactuate the water valve 48 and turn off the water. Another means is for a timed fill wherein the water valve 48 is actuated when the mold 12 is empty to allow the flow of water into the mold 12 for a predetermined set period of time and then the water valve is deactuated. Whatever type of water fill arrangement is utilized, it may be used in conjunction with this invention and it will be understood that incoming water fill flow from the conduit 30 into the ice mold 12 periodically to fill the ice mold, then shut off until the ice pieces are frozen and dumped and the ice mold is in position to receive the next charge of water for subsequent freezing into ice pieces.

There will now be described the signal means and method for indicating when water in the ice mold 12 is frozen and ready for the ice pieces to be removed from the ice mold 12. The signal means includes a temperature sensing assembly 50 located in the freezer compartment 2 and spaced from the ice mold 12. In the case of the embodiment shown in FIGS. 1, 2 and 3, assembly 50 includes a portion 52 of the transition conduit 42 surrounded by an insulation member 54. The portion 52 of conduit 42 has a reservoir 56 formed therein as part of the transition conduit 42. The reservoir 56 is arranged so that a small amount of incoming water flowing through the transition conduit 42 during the fill operation will remain in the reservoir 56 when the water valve 48 is deactuated to stop the flow of water into the ice mold 12. This amount of water retained in the reservoir 56 represents a thermal mass 58 and is analogous in temperature to the temperature of the contents in compartments 16 of the ice mold 12. Thus, when the thermal mass 58 of water is frozen, the water in the mold 12 will also be frozen at very nearly the same time. The thermal mass 58 is in heat transfer relationship with the water flowing through the transition conduit 42 from the water valve 48 to the ice mold 12. Located in temperature sensing relationship with the thermal mass 58 is any suitable temperature sensing means 60 which can be calibrated to actuate the signal means when the water in the ice mold 12 reaches a pre-selected temperature below 32° F. The signal means may include a visual indicator such that when the pre-selected temperature has been reached, the temperature sensing means 60 will actuate the visual indicator, such as a light, whereby the user of the ice maker will know that the ice pieces are ready to be removed from the ice mold manually. Alternatively, the signal means may generate a signal to the ice maker whereupon the motor driven mechanism 18 will be energized and the ice piece removal operation or harvesting of the ice pieces will be initiated.

After the ice pieces have been removed or harvested from the flexible ice mold 12 and the tray is returned to its upright level position, as shown in FIGS. 1 and 2, the ice maker mechanism will actuate the water valve 48 for a period of time in any suitable manner, as previously discussed, to again allow incoming water to flow from the water valve 48 through conduit 30, transition conduit 42, trough 46, into the mold 12. The incoming water flowing through the transition conduit 42 will be considerably warmer than the thermal mass 58 which, at this time, is a frozen analogous ice piece formed in the reservoir 56 from the water left in the reservoir 56 during the previous fill operation. The heat of the incoming water will melt the ice piece in the reservoir 56 and thus remove it from the reservoir 56. Upon deactuation of the water valve 48, again as by any suitable means such as previously discussed, the incoming water will stop flowing through the transition conduit 42 and a small amount of the water will again remain in the reservoir 56 to act as the thermal mass 58 to determine when the temperature of the contents in the mold 12 has reached a preselected temperature below 32° F., thus indicating the water in the mold 12 is frozen and the ice pieces are ready to be harvested.

Figure 3:
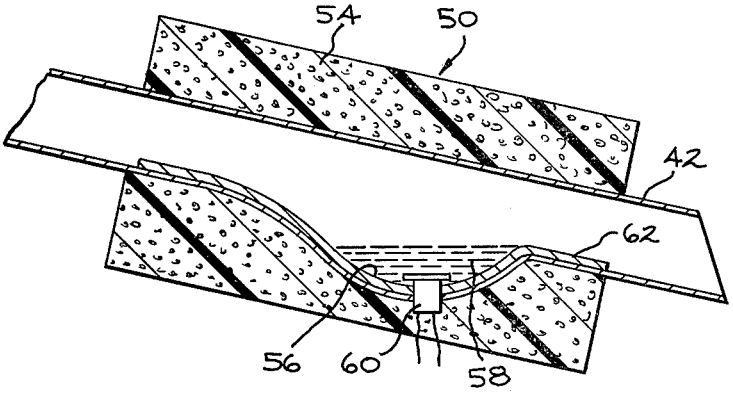
FIG. 3 is a fragmentary cross sectional view of a portion of the present invention shown in FIGS. 1 and 2.

When the relatively warm incoming water passes in thermal contact with the thermal mass 58 which is the analogous ice piece in the reservoir 56, it is warmed and melted from the top. If desired, the thermal mass 58 may also be warmed from the bottom or underside. As shown in FIG. 3, to accomplish this a thermal conductive member 62 may be utilized to line the bottom of reservoir 56. In this manner the heat from the incoming water will also be conducted by the thermal conductive member 62 to the underside of the analogous ice piece and cause it to melt thus aiding in having the analogous ice piece removed from the reservoir 56 by the warm incoming water.

By forming the reservoir 56 to ratain a certain amount of incoming water and providing an appropriate insulating member 54 around the reservoir the conditins between freezing of the water in the ice mold 12 and freezing the thermal mass water in the reservoir 59 can be simulated. That is, the water in the ice mold 12 will be frozen at the same or very nearly the same time as the water in the reservoir 59. The calibration of the temperature-sensing means 60 will be preselected and set to a temperature below 32° F., usuall about 15° F., to cause a signal to be generated indicating that the analogous ice piece and the ice pieces in the mold 12 have been frozen.

Figure 4:
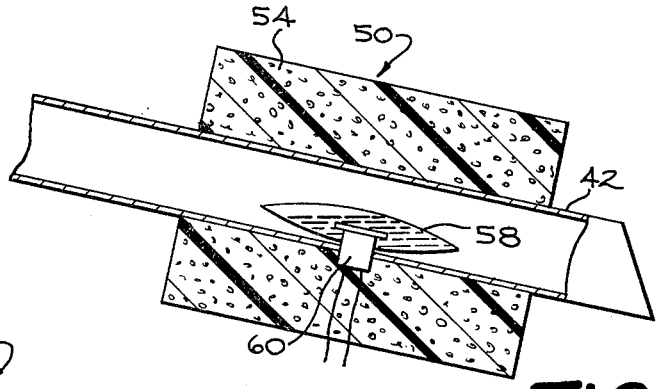
FIG. 4 is a fragmentary cross sectional view similar to FIG. 3 showing an alternate embodiment of the invention.

FIG. 4 is an alternate embodiment of the temperature-sensing assembly 50 wherein the thermal mass 58 is an encapsulated body of water, wax or other suitable material which goes through a change of state upon being cooled to a temperature between 90° F. and −20° F. To utilize the thermal capacity and the time lag of the change-of-state transition in the thermal mass material, the material must be capable of performing two functions. First, the material must change state below the temperature of the incoming water so that the incoming water can heat the material to its transition temperature and effect the transition. The upper limit of 90° F. is selected for as a practical matter in the environment for which this invention is intended the temperature of incoming water would not normally be above that temperature. The second function for the change-of-state thermal mass material is for it to change state above the temperature of the cold air which surrounds it and cools it to its transition temperature and effect the transition. While the air in the freezer compartment 2 is seldom below −10° F., there is the possibility that some air being delivered to the freezer compartment 2 from the evaporator may be colder and, therefore, the lower limit of −20° F. is selected as being practical in the environment for which this invention is intended. The encapsulated thermal mass 58 is permanently located or secured within the transition conduit 42 and is warmed by the incoming water to increase the temperature of the material encapsulated to approximately that of the incoming water. By choosing the desired thermal mass 58 material, its quantity and the amount of insulation afforded to the thermal mass 58 by the insulation member 54, the thermal mass change-of-state transition can simulate a preselected temperature comparative to the temperature of the frozen ice pieces in the ice mold 12 below 32° F.

Figure 5:
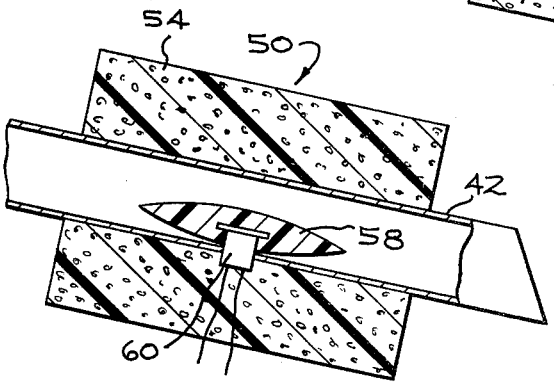
FIG. 5 is a fragmentary cross sectional view similar to FIG. 3 showing an alternate embodiment of the invention shown in FIGS. 3 and 4.

FIG. 5 is another alternate embodiment of the temperature sensing assembly 50 wherein the material of the thermal mass 58 does not have the capability of a change of state but may nevertheless be used as an analogous ice piece and when the temperature of the thermal mass 58 reaches a preselected temperature comparative to the temperature of the frozen ice pieces in the ice mold 12 below 32° F., the temperature sensing means 60 will actuate the signal means indicating that the ice pieces in the ice mold 12 are ready to harvest.

Figure 6:
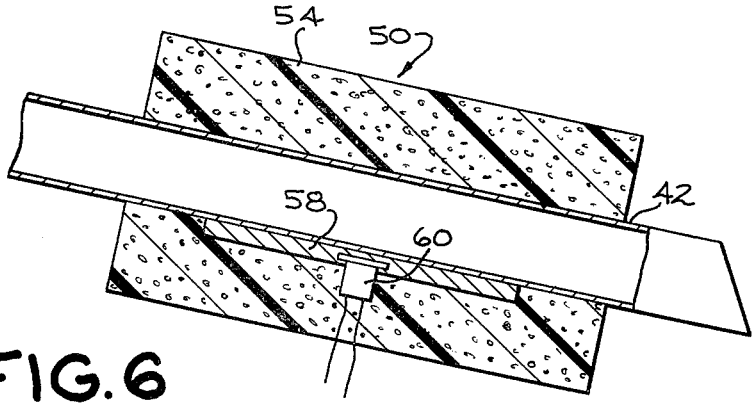
FIG. 6 is a fragmentary cross sectional view similar to FIG. 3 showing an alternate embodiment of the invention shown in FIGS. 3, 4 and 5.

FIG. 6 is another alternate embodiment of the temperature sensing assembly 50 wherein the thermal mass 58 is located adjacent the transition conduit 42 and comprises a heat absorbing material which is in heat transfer relationship with the incoming water flowing within the transition conduit 42 from the water valve 48 to the mold 12. Again, the type of material of the thermal mass 58, its quantity and the amount of insulation afforded thereto by insulating member 54 will determine at what comparative temperature the temperature-sensing means 60 will actuate the signal means indicating that the ice pieces in the ice mold 12 are ready to harvest.

By my invention there is provided an icemaker that utilizes a thermal mass 58 that is spaced from the ice mold 12 and is in heat transfer relationship with incoming water flowing through the transition conduit 42 from the water valve 48 to the ice mold 12 during the ice mold water filling operation. The temperature sensing means 60 is in effect reset by each charge of incoming water by heat from the incoming water raising the temperature of the thermal mass 58 to a temperature analogous to the temperature of the water in the ice mold 12 that is to be subsequently frozen. In the case of a flexible mold type ice maker, the temperature sensing means 60 being spaced or remote from the ice mold 12 requires no complicated and often unreliable electrical connections that would be necessary to allow rotation of the mold 12 during the ice piece harvesting operation. In addition, the problem of some of the ice pieces remaining in the compartments 16 of mold 12 where the temperature sensor might be located thereby giving a false temperature reading that actuates prematurely the ice maker to harvest the ice pieces is eliminated. By having the analogous ice piece or thermal mass 58 heated by the incoming water to a temperature which is very nearly identical to that of the water in the ice mold 12 the simulation or comparison of the thermal mass 58 temperature to that of the temperature of the frozen ice pieces as soon as they are all frozen and ready to harvest is accurately accomplished. This then assures that the ice pieces are not harvested before they are completely frozen and that they are harvested soon after they are frozen, thus assuring an optimum ice piece harvesting rate.

The foregoing is a description of the preferred embodiment of the invention and it should be understood that variations may be made thereto without departing from the true spirit of the invention, as defined in the appended claims.

What is claimed is:

1. An ice maker in a freezer compartment with a mold containing a plurality of spaced cavities for forming ice pieces, water conduit means for introducing water into the mold, a wate valve, and signal means to indicate when the water in the mold is frozen including temperature sensing means, the improvement comprising:

a thermal mass in the freezer compartment and spaced from the mold, said thermal mass being in heat transfer relationship with the water flowing through the conduit from the water valve to the mold, said temperature sensing means being in temperature sensing relationship with the thermal mass and calibrated to actuate the signal means when the water in the mold reaches a preselected temperature below 32° F.

2. In the ice maker of claim 1 wherein the thermal mass is a substance which goes through a physical change of state upon being cooled to a temperature between 90° F. and −20° F.

3. In the ice maker of claim 2 wherein the thermal mass is water.

4. In the ice maker of claim 3 wherein the thermal mass of water is provided by a chamber that is in water flow communication with the conduit means delivering water from the water valve to the mold and arranged to retain a small portion of the water passing through the conduit means.

5. In the ice maker of claim 1 wherein the signal means includes a visible indicator.

6. An automatic ice maker in a freezer compartment with a mold containing a plurality of spaced cavities for forming ice pieces and means responsive to a signal to eject the ice pieces from the mold, water conduit means for introducing water into the mold, a water valve, and signal means including temperature sensing means to actuate the means to eject ice pieces from the mold, the improvement comprising:

a thermal mass in the freezer compartment and space from the mold, said thermal mass being in heat transfer relationship with the water flowing through the conduit from the water valve to the mold, said temperature sensing means being in temperature sensing relationship with the thermal mass and calibratd to actuate the signal means when the water in the mold reaches a preselected temperature below 32° F.

7. In the ice maker of claim 6 wherein the thermal mass is a substance which goes through a physical change of state upon being cooled to a temperature between 90° F. and −20° F.

8. In the ice maker of claim 7 wherein the thermal mass is water.

9. In the ice maker of claim 8 wherein the thermal mass of water is provided by a chamber that is in water flow communication with the conduit means delivering water from the water valve to the mold and arranged to retain a small portion of the water passing through the conduit means.

10. In the ice maker of claim 6 wherein the mold is flexible and the mold is flexed to eject the ice pieces from the mold.

11. In the ice maker of claim 9 wherein the bottom of the chamber has a layer of thermally-conductive material.

12. The improved method of controlling the ejection of ice pieces made by an ice maker contained in a freezer compartment including a mold having a plurality of spaced cavities for forming ice pieces, water conduit means for introducing water into the mold, a water valve, and signal means to indicate when the water in the mold is frozen including temperature sensing means, comprising:

providing a thermal mass in the freezer compartment and spaced from the mold, said thermal mass being in heat transfer relationship with the water flowing through the conduit from the water valve to the mold;

sensing the temperature of the thermal mass with the temperature sensing means; and generating a signal when the water in the mold reaches a preselected temperature below 32° F.

13. The method of claim 12 wherein the thermal mass is a substance which goes through a physical change of state upon being cooled to a temperature between 90° F. and −20° F.

14. The method of claim 13 wherein the physical change of state of the substance occurs at approximately 32° F.

15. The method of claim 14 wherein the substance is water.

16. The method of claim 12 wherein actuation of the signal means displays a visible indicator.

17. The improved method of controlling the ejection of ice pieces made by an automatic ice maker contained in a freezer compartment including a mold containing a plurality of spaced cavities for forming ice pieces and means responsive to a signal to eject the ice pieces from the mold, water conduit means for introducing water into the mold, a water valve, and signal means including temperature sensing means to actuate the means to eject ice pieces from the mold, comprising:

providing a thermal mass in the freezer compartment and spaced from the mold, said thermal mass being in heat transfer relationship with the water flowing through the conduit from the water valve to the mold;

sensing the temperature of the thermal mass with the temperature sensing means, and generating a signal when the water in the mold reaches a preselected temperature below 32° F.

18. The method of claim 17 wherein the thermal mass is a substance which goes through a physical change of state upon being cooled to a temperature between 90° F. and −20° F.

19. The method of claim 18 wherein the physical change of state of the substance occurs at approximately 32° F.

20. The method of claim 19 wherein the substance is water.

21. The improved method of controlling the ejection of ice pieces made by an automatic ice maker contained in a freezer compartment, the ice maker including a flexible mold containing a plurality of spaced cavities for forming ice pieces and means responsive to a signal for flexing the mold to eject the ice pieces from the mold, water conduit means for introducing water into the mold, a water valve, and signal means including temperature sensing means to actuate the means for flexing the mold to eject ice pieces from the mold, comprising:

providing a stationary, ice forming chamber in the freezer compartment and spaced from the flexible mold and in water flow communication with the conduit means delivering water from the water valve to the mold;

retaining a small portion of the water passing through the conduit means in the ice forming chamber, sensing the temperature of the ice forming chamber with the temperature sensing means, and generating a signal when the water in the mold reaches a preselected temperature below 32° F.

22. The improved method of claim 21 for controlling the ejection of ice pieces made by an automatic ice maker with a flexible mold wherein the ice formed in the stationary ice forming chamber is melted by incoming water from the water conduit means.

23. The improved method of claim 22 wherein the bottom of the chamber has a layer of thermally conductive material.

* * * * *